US010038291B2

(12) United States Patent
Arrowsmith et al.

(10) Patent No.: US 10,038,291 B2
(45) Date of Patent: Jul. 31, 2018

(54) APPARATUS FOR PROVIDING A ROTATABLE COUPLING BETWEEN AUDIO CABLES

(71) Applicants: Orange Music Electronic Company Limited, Borehamwood, Herfordshire (GB); KBO Dynamics International Ltd., Stanley, County Durham (GB)

(72) Inventors: Colin Arrowsmith, Rowlands Gill (GB); Andrew Fallon, Belmont (GB)

(73) Assignees: Orange Music Electronic Company Limited, London (GB); KBO Dynamics International Limited, Stanley, County Durham (GB)

( * ) Notice: Subject to any disclaimer, the term of this patent is extended or adjusted under 35 U.S.C. 154(b) by 0 days.

(21) Appl. No.: 15/531,005

(22) PCT Filed: Nov. 28, 2015

(86) PCT No.: PCT/GB2015/000311
§ 371 (c)(1),
(2) Date: May 26, 2017

(87) PCT Pub. No.: WO2016/083768
PCT Pub. Date: Jun. 2, 2016

(65) Prior Publication Data

US 2017/0324205 A1 Nov. 9, 2017

(30) Foreign Application Priority Data

Nov. 29, 2014 (GB) ..... 1421280.7

(51) Int. Cl.

| | |
|---|---|
| ***H01R 39/00*** | (2006.01) |
| ***H01R 39/64*** | (2006.01) |
| ***H01R 39/28*** | (2006.01) |
| ***H01R 24/58*** | (2011.01) |
| ***H01R 13/627*** | (2006.01) |
| *H01R 107/00* | (2006.01) |

(52) U.S. Cl.
CPC ..... *H01R 39/643* (2013.01); *H01R 13/6276* (2013.01); *H01R 24/58* (2013.01); *H01R 2107/00* (2013.01)

(58) Field of Classification Search
CPC ..... H01R 39/643; H01R 39/64; H01R 39/00; H01R 39/28; H01R 35/04
USPC ..... 439/13, 17, 18–28
See application file for complete search history.

(56) References Cited

U.S. PATENT DOCUMENTS 3,185,951 A 5/1965 Le Beau
4,909,741 A * 3/1990 Schasteen ..... E21B 17/028 439/13

(Continued)

FOREIGN PATENT DOCUMENTS

EP 0089625 A1 9/1983

*Primary Examiner* — Gary Paumen
(74) *Attorney, Agent, or Firm* — James Creighton Wray; Meera P. Narasimhan

(57) ABSTRACT

A rotatable coupling for audio cables is shown having a stator and a rotor divining an electrical rotary interface (301) for providing continuous connection between audio cables. A protective stator housing (304) retains the stator and a protective rotor housing (305) retains the rotor. A rolling-element bearing (306) with an inner race and an outer race allows the protective housings to axially rotate.

9 Claims, 8 Drawing Sheets

(56) References Cited

U.S. PATENT DOCUMENTS

| | | | | |
|---|---|---|---|---|
| 5,575,664 | A * | 11/1996 | Sobhani | B60R 16/027 439/17 |
| 7,473,098 | B1 | 1/2009 | Poulos | |
| 7,637,744 | B2 * | 12/2009 | Singer | F16C 41/002 439/17 |
| 8,512,047 | B2 * | 8/2013 | Li | H01R 24/542 439/20 |
| 9,039,423 | B2 * | 5/2015 | Shinder-Lerner | H01R 39/64 310/232 |
| 2014/0120742 | A1 | 5/2014 | Shinder-Lerner | |

* cited by examiner

APPARATUS FOR PROVIDING A ROTATABLE COUPLING BETWEEN AUDIO CABLES

CROSS REFERENCE TO RELATED APPLICATIONS

This application claims priority from United Kingdom patent application number 14 21 280.7 filed 29 Nov. 2014, the entire disclosure of which is incorporated herein by reference in its entirety.

TECHNICAL FIELD

The present invention relates to an apparatus for providing a rotatable coupling between a first audio cable and a second audio cable.

BACKGROUND OF THE INVENTION

It is known to use an electrical rotary interface, also known as a slip ring, having a mercury conductor to connect two portions of an audio cable for a musical instrument that produces an electrical output, such as an electric guitar. Such a design is disclosed in U.S. Pat. No.7,473,098 to Poulos. This approach has several disadvantages. The use of a mercury-based electrical rotary interface means that the cable inherits all of the necessary handling precautions which must go along with devices containing mercury—which in particular cannot be taken aboard commercial flights. The design adopted by Poulos does not provide the requisite environmental protection for the electrical rotary interface, in terms of both resistance to tugging of the cable and impact protection. The mercury-based electrical rotary interface must be used in a vertical orientation, in order for the mercury therein to make a connection. This can be unreliable during operation leading to audio drop out and distortion.

It is therefore an object of the present invention to provide an improved audio cable for a musical instrument that produces an electrical output, in terms of both its compliance with transport regulations, durability and reliability.

BRIEF SUMMARY OF THE INVENTION

According to an aspect of the present invention, there is provided an apparatus for providing a rotatable coupling between a first audio cable and a second audio cable, comprising: an electrical rotary interface having a stator and a rotor, for providing continuous connection between said first audio cable and said second audio cable; a protective stator housing in which said stator is retained to rotate therewith; a protective rotor housing in which said rotor is retained to rotate therewith; and a rolling-element bearing with an inner race and an outer race, wherein the said protective rotor housing is journaled in said inner race and said outer race is journaled in said protective stator housing; whereby the protective housings are axially rotatable relative to one another.

In an embodiment, said stator is retained by a first snap ring which is located in a first groove in an inner surface of said protective stator housing.

DETAILED DESCRIPTION OF EXAMPLE EMBODIMENTS

FIG. 1

Figure 1:
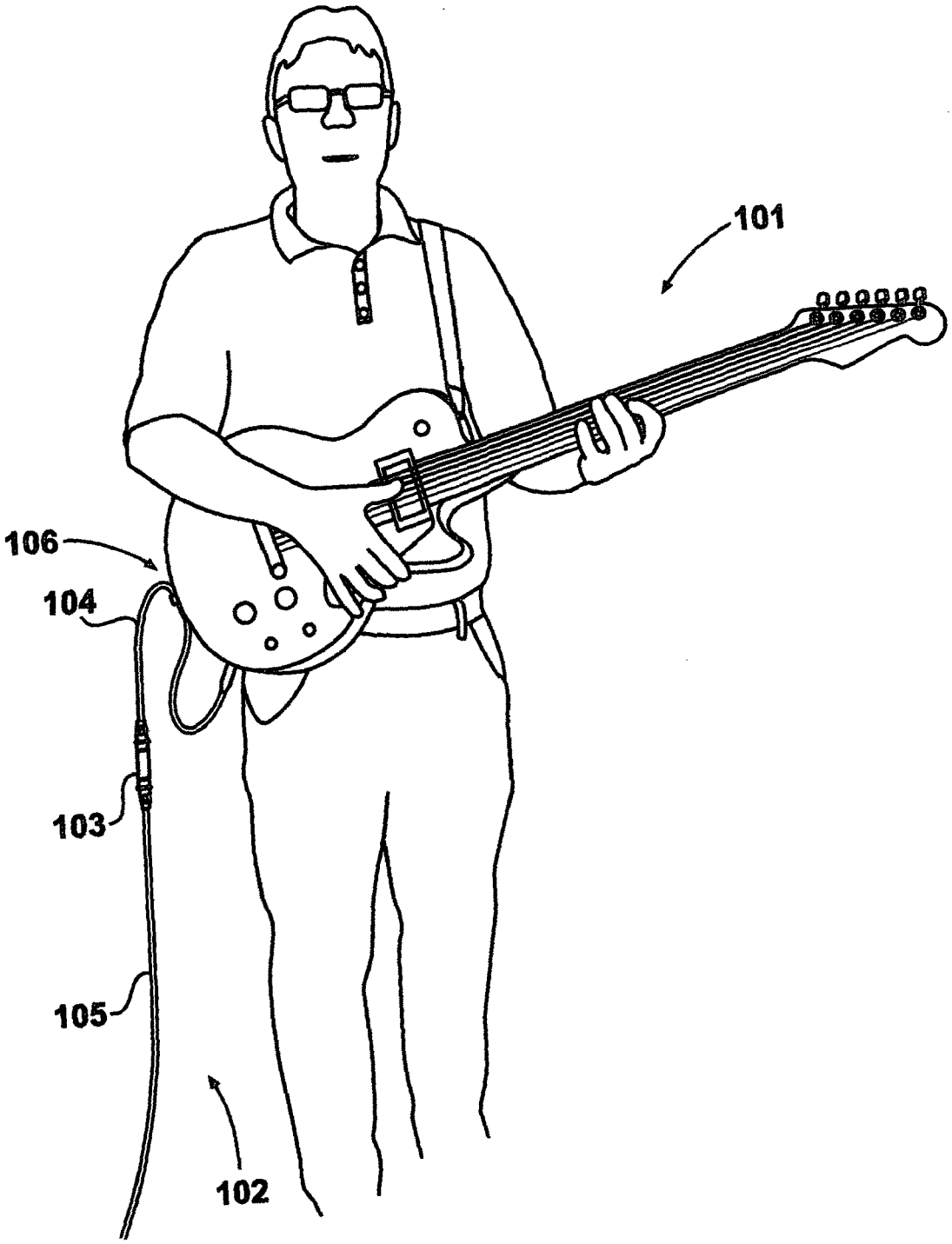
FIG. 1 shows an environment in which the present invention may be used.

A guitarist is shown in FIG. 1 playing an electric guitar 101. By using one or more pickups to convert the vibration of its strings into electrical impulses, the electric guitar 101 produces an electrical output which is amplified prior to reproduction by a loudspeaker. This electrical output is carried from the electric guitar 101 to an amplifier (not shown) via an audio cable 102 which plugs into the guitar; the audio cable embodying one aspect of the present invention.

When playing an electric guitar, especially on stage, it is common for movement around the playing environment to cause twisting and tangling of normal audio cables.

Thus, the audio cable 102 of the present invention includes a rotatable coupling 103 between a first portion 104 and a second portion 105 of the audio cable 102. The rotatable coupling 103 is endlessly rotatable such that rotation of the first portion 104 does not cause twisting of the second portion 105 of the audio cable 102.

In the illustrated embodiment, the first portion 104 can be seen to be shorter in length than the second portion 105. In an embodiment, this is advantageous because, when the audio cable 102 is plugged into an electric guitar and in use, the rotatable coupling 103 occupies a substantially vertical orientation. This "mid-air" positioning of the rotatable coupling 103 aids in preventing transmission of rotation between the first and second portions of the audio cable 102. Indeed, as illustrated in the Figure, it is typical for guitarists to tuck audio cables between a body portion and a strap of the guitar; which configuration is identified at 106. The audio cable 102 therefore has, in this specific embodiment, a length which allows such an arrangement without rotatable coupling 103 being too close to the guitarist. In a specific embodiment, the length of the first portion 104 is therefore selected as about sixty centimeters. The length of the second portion 105 can be of any length, with typical lengths being about five to ten meters. When plugging in an electric guitar using the audio cable 102, the first portion 104 would be plugged into the electric guitar, and the second portion 105 of the cable would be plugged into an amplifier.

It will be appreciated that the audio cable 102 illustrated in FIG. 1 has being configured for use as a guitar cable. However, it will be understood by those skilled in the art that the audio cable 102 of the present invention has application with other musical instruments that produce electric output, and in particular those where the twisting of an audio cable occurs.

FIG. 2

Figure 2:
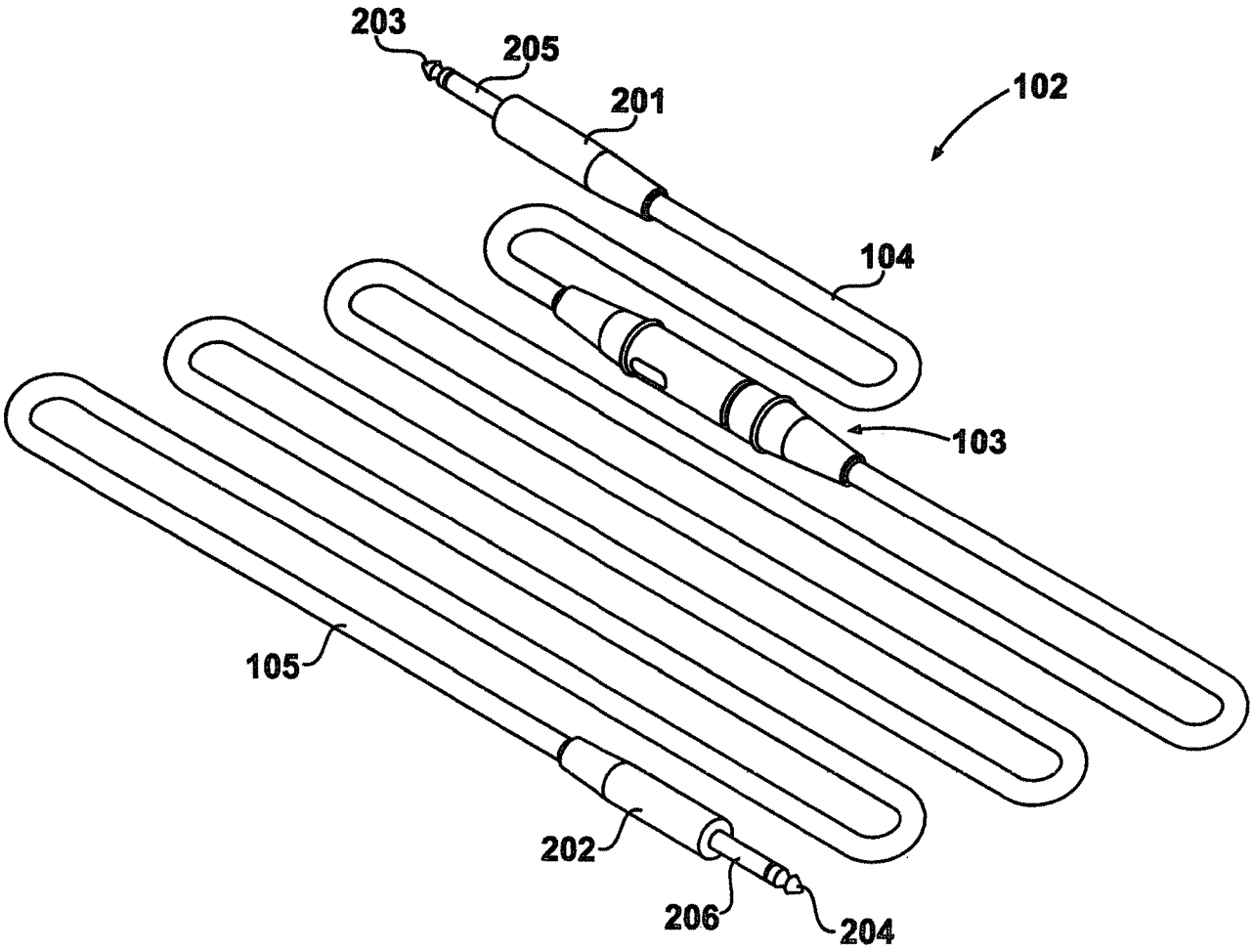
FIG. 2 shows the audio cable of the present invention, which includes a rotatable coupling.

Audio cable 102 is shown in isolation and in its entirety in FIG. 2. The cable includes, at one end of first portion 104, a first audio connector plug 201; and, at one end of second portion 105, a second audio connector plug 202. In the present embodiment, being configured for use as an electric guitar cable, the two audio connectors are one-quarter inch two-contact phone connectors of the known type. Thus, each has a tip: tip 203 and tip 204; and each has a sleeve: sleeve 205 and sleeve 206. This enables a monophonic signal to be conducted into the termination equipment; be it the electric musical instrument or the amplifier. The tips conduct the audio signal, whilst the sleeves are connected to ground.

The rotatable coupling 103 is located between first portion 104 and second portion 105 of the audio cable 102, and facilitates a permanent connection between each portion of audio cable 102, while providing endless rotation.

FIG. 3

Figure 3:
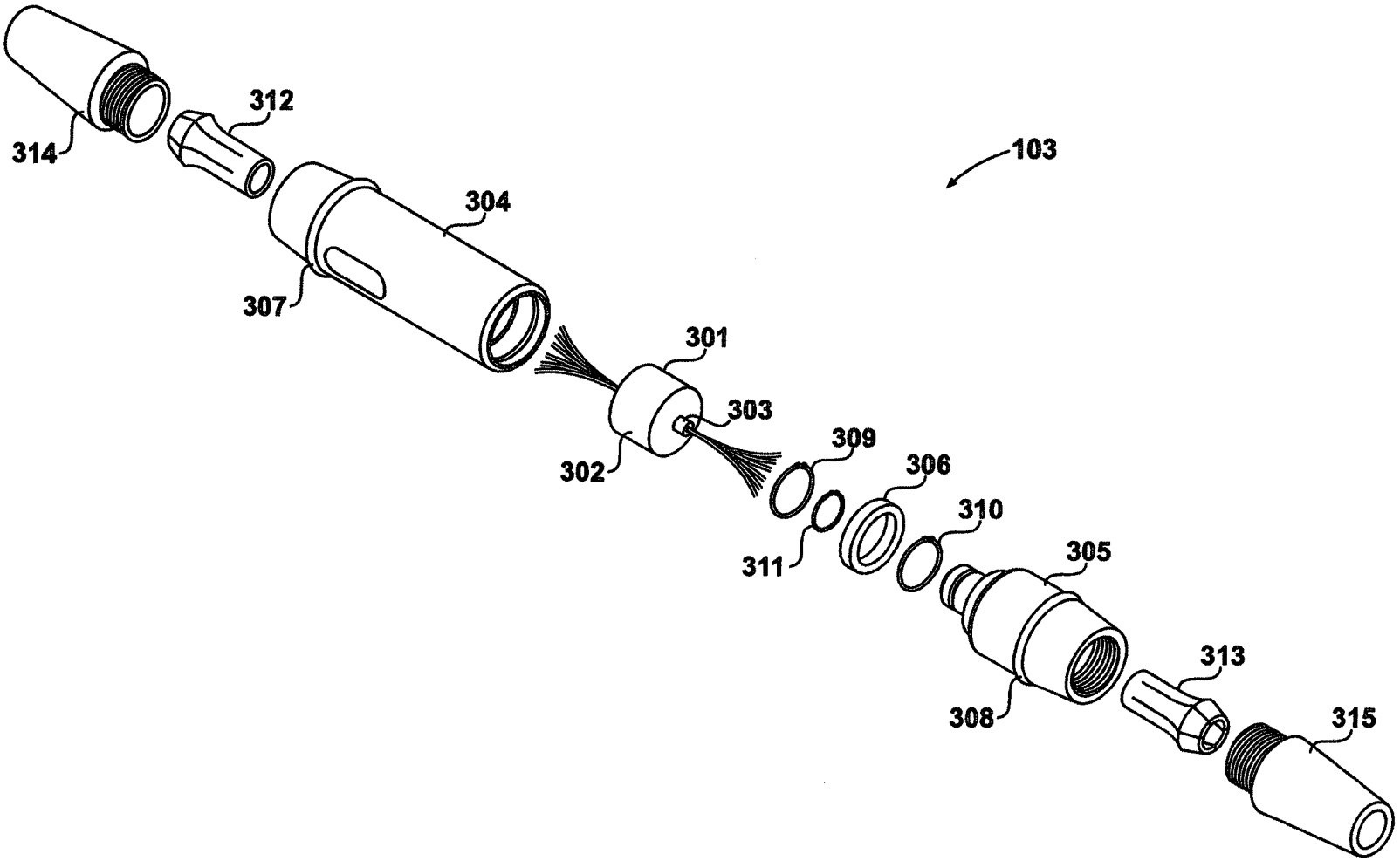
FIG. 3 shows components forming the rotatable coupling, in an isometric view.

Rotatable coupling 103 is shown in isometric view in FIG. 3, in an exploded view, to illustrate individual component parts. The rotatable coupling 103 comprises an electrical rotary interface 301 that provides continuous electrical connection between the two portions 104 and 105 of audio cable 102. Electrical rotary interfaces will also be known to those skilled in the art as slip rings. The electrical rotary interface 301 in the present embodiment provides six conducting paths therethrough. The electrical connections to the first portion 104 and the second portion 105 of the audio cable 102 will be described with reference to FIG. 7. Referring again to FIG. 3, the electrical rotary interface 301 comprises a stator 302 and a rotor 303.

The rotatable coupling 103 further comprises a protective stator housing 304 and a protective rotor housing 305. The two housings are, in an embodiment, machined from stainless steel or aluminium, although other production processes and materials could be adopted. The housings are provided to allow a standard electrical rotary interface to be deployed, despite the physical shocks and impacts that audio cable 102 may be subjected to during use and storage.

To facilitate relative axial rotation between the protective stator housing 304 and the protective rotor housing 305, a rolling-element bearing 306 is provided. As will be described with reference to FIGS. 5 and 6, the configuration of the protective stator housing 304, the protective rotor housing 305 and rolling-element bearing 306 moves the critical stress concentration point between the static and rotating part of rotatable coupling 102 during deflection events away from the join of the stator 302 and the rotor 303 of the electrical rotary interface 301. This is normally a weak point in electrical rotary interfaces of the size required for use in the audio cable 102 of the present invention—typically about ten millimeters in diameter for the stator and about four millimeters in diameter for the rotor. Instead, the critical stress concentration point is moved to the location of the rolling-element bearing 306, which provides a larger surface area and thus can withstand greater forces. Furthermore, shock resistance is provided in a specific illustrated embodiment by the provision of a first rubber O-ring 307 on the protective stator housing 304, and a second rubber O-ring 308 on the protective rotor housing 305.

In the present embodiment, three snap rings 309, 310 and 311 are provided to keep the electrical rotary interface 301, the protective stator housing 304, the protective rotor housing 305 and rolling-element bearing 306 joined together. The arrangement of the first snap ring 309, the second snap ring 310, and the third snap ring 311 is shown in and will be described further with reference to FIGS. 5 and 6.

Finally, in order to prevent the first and second portions of the audio cable 102 from being pulled out of the protective stator housing 304 and the protective rotor housing 305, a first collet 312 and a second collet 313 are respectively provided. A first end cap 314 and a second end cap 315 are also provided to retain the collets in the protective stator housing 304 and the protective rotor housing 305 respectively, by screwing therein.

FIG. 4

Figure 4:
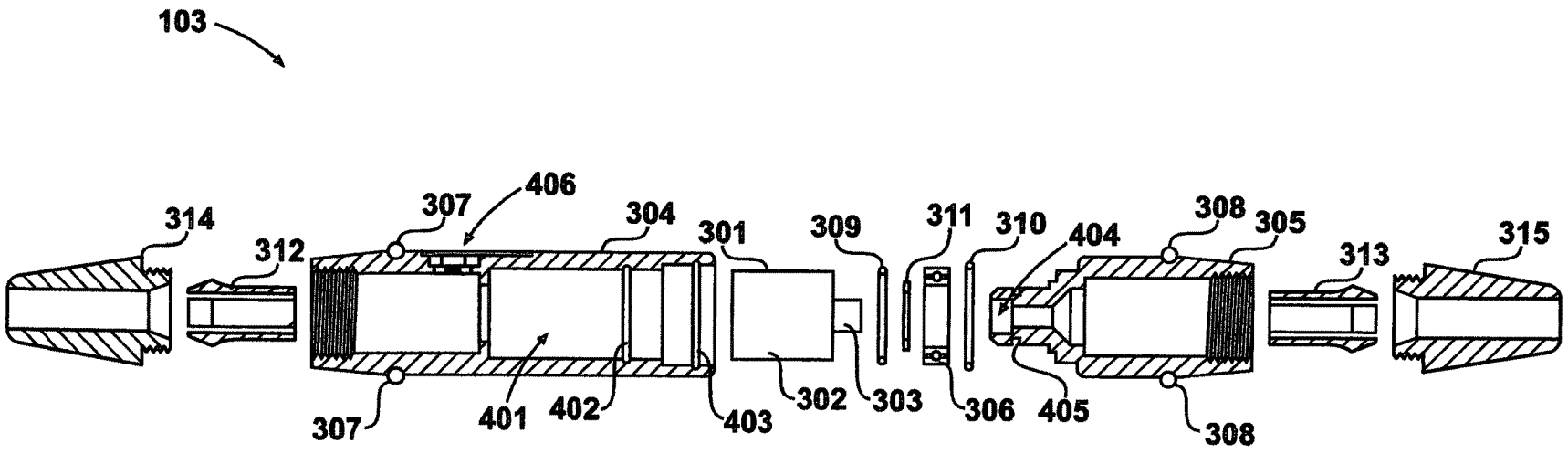
FIG. 4 shows the components forming rotatable coupling 103 in a cross-sectional view.

A cross sectional view of the components previously identified in FIG. 3, is shown in FIG. 4. The protective stator housing 304 comprises an internal void 401 which is dimensioned such that the stator 302 of the electrical rotary interface 301 may be retained therein by an interference fit. Thus, its dimensions are only just larger than the outer dimensions of the stator 302. In order to prevent removal in spite of the interference fit, however, the inner surface of the protective stator housing 304 also includes a first circumferential groove 402 for receiving the first snap ring 309. A second circumferential groove 403 is also provided on said inner surface for receiving the second snap ring 310.

The protective rotor housing 305 includes a recess 404 that is dimensioned such that the rotor 303 of the electrical rotary interface 301 may be retained therein by an interference fit. Thus, its dimensions are only just larger than the outer dimensions of the rotor 303. The outer surface of the protective rotor housing 305 includes a third circumferential groove 405 for receiving the third snap ring 311.

The way in which the three snap rings prevent the protective rotor and stator housings from being pulled apart under strain will be described with reference to FIG. 6.

Finally, a grounding point 406 is provided in the protective stator housing 304 for connection to the sleeve conductor of the audio cable 102. In this way, electrical interference is minimised by having the entire rotatable coupling 103 being grounded. The connection to the sleeve conductor will be described further with reference to FIG. 5.

FIG. 5

Figure 5:
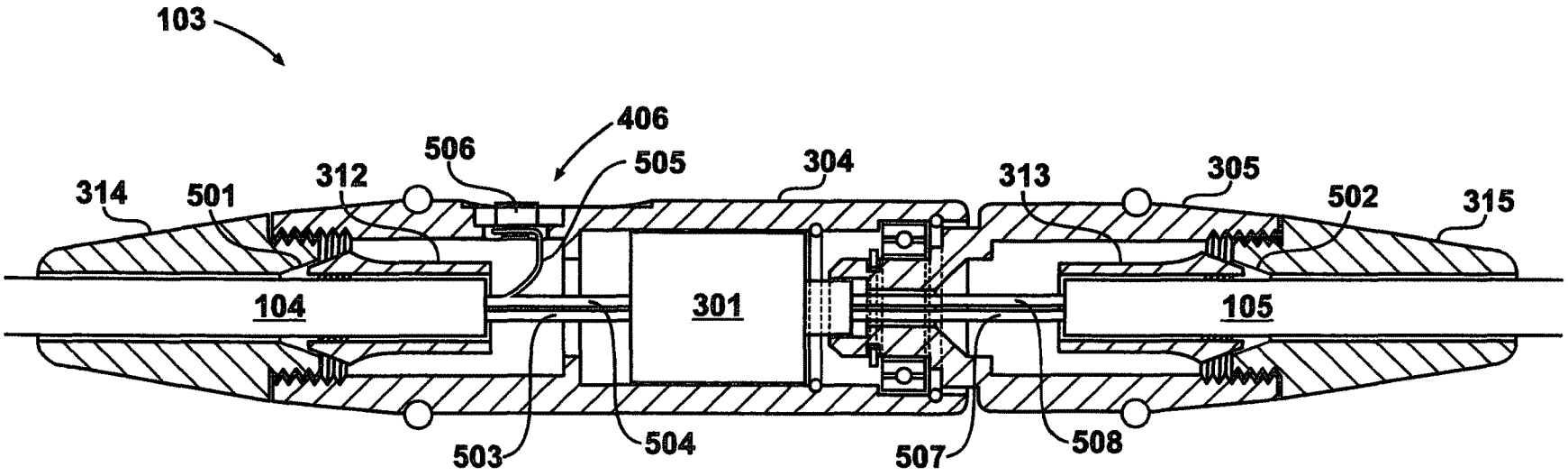
FIG. 5 shows the rotatable coupling in assembled form, in a cross-sectional view

A cross-sectional view of the rotatable coupling 103 in assembled form is shown in FIG. 5. The first portion 104 of audio cable 102 is retained in the protective stator housing 304. This is achieved by first collet 312. The first collet 312 clamps the outer coating (which may be a braided or smooth plastic coating) of first portion 104, which clamping is tightened when the first portion of the audio cable is pulled. The clamping is tightened through provision of a conical throat 501 on the interior of the first end cap 314, which cooperates with the collet 312 to cause it to further clamp the first portion 104. A similar arrangement is provided for second portion 105, which is retained in the protective rotor housing 305 by second collet 313, which, in turn, tightens its clamp due to a conical throat 502 on the interior of the second end cap 315.

In terms of transmission of an audio signal, the first portion 104 of audio cable 102 includes a first tip conductor 503 for carrying signals from the tip 203 of the first audio connector plug 201. It also includes a first sleeve conductor 504 which maintains grounding via the sleeve 205 of the first audio connector plug 201. The first sleeve conductor 504 is connected via a short wire 505 to the grounding point 406. The wire 505 is retained in place by a grub screw 506 which threads into the protective stator housing 304 at the grounding point 406.

Both of the conductors 503, 504 connect to the electrical rotary interface 301 on the stator side. On the rotor side of the electrical rotary interface 301, a second tip conductor 507 and a second sleeve conductor 508 are connected thereto; these conductors form part of the second portion 105 of audio cable 102. The second tip conductor 507 is connected to the tip 204 of the second audio connector plug 202, and a second sleeve conductor 508 is connected to the sleeve 206. The internal configuration of electrical rotary interface 301 is shown and will be described with reference to FIG. 7.

FIG. 6

Figure 6:
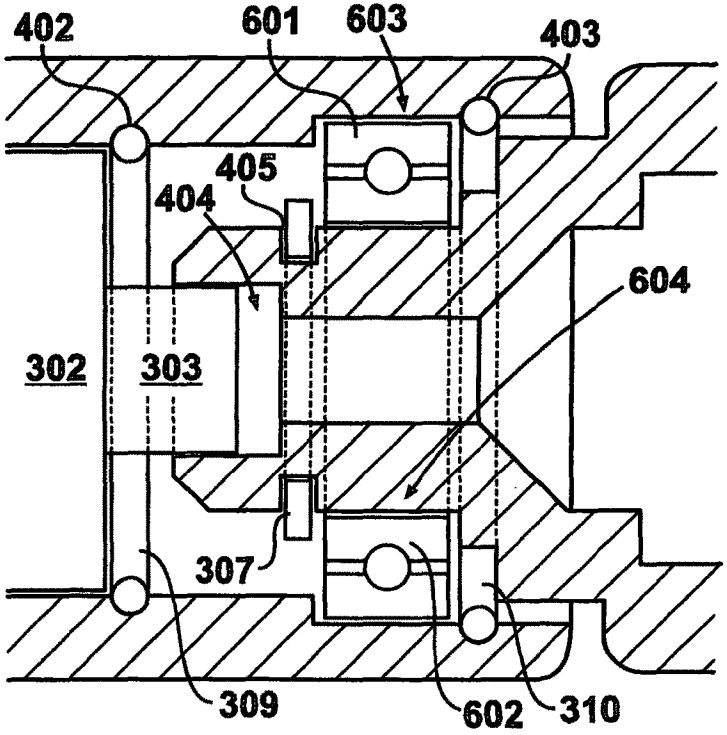
FIG. 6 shows an expanded view of the cross-section of the join between the protective stator and rotor housings of the rotatable coupling.

An expanded view of the cross-section of the join between the protective stator housing 304 and the protective rotor housing 305 is shown in FIG. 6. When assembled, the stator 302 of the electrical rotary interface 301 is retained in the protective stator housing 304 by the first snap ring 309 which resides in first groove 402. Further retention is provided in the present embodiment by the interference fit of the stator 302 of the electrical rotary interface 301 in the internal void 401. In this way, the stator 302 rotates with the protective stator housing 304.

The rotor 303 of the electrical rotary interface 301 is retained in the protective rotor housing 304 by the interference fit in the recess 404. In this way, the rotor 303 rotates with the protective stator housing 305.

As described previously, rotation between the housings is facilitated by the rolling-element bearing 306 which, in the present embodiment, is a ball bearing; although alternatives could be used such as needle-element bearings. The rolling-element bearing 306 has an outer race 601 and an inner race 602, which rotate relative to one another.

The outer race 601 of the rolling-element bearing 306 provides a bearing surface for a section 603 of the inner surface of the protective stator housing 304. Thus, the outer race 601 is journaled in the protective stator housing 304. The second snap ring 310 in second groove 403 retains the rolling-element bearing 306 in place and prevents it from being pulled out of the protective stator housing 304.

The inner race 602 of the rolling-element bearing 306 provides a bearing surface for a section 604 of the outer surface of the protective rotor housing 305, which section is between the recess 405 and the second snap ring 310. Thus, the protective rotor housing 305 is journaled in the inner race 602. The third snap ring 307 in the recess 405 also retains the protective rotor housing 305 in place in the rolling-element bearing 306 and prevents it from being pulled out.

Thus, in the present embodiment, the combination of the second snap ring 310 and the third snap ring 311 either side of the rolling-element bearing 306, prevent the rotatable coupling 103 from being pulled apart.

FIG. 7

Figure 7:
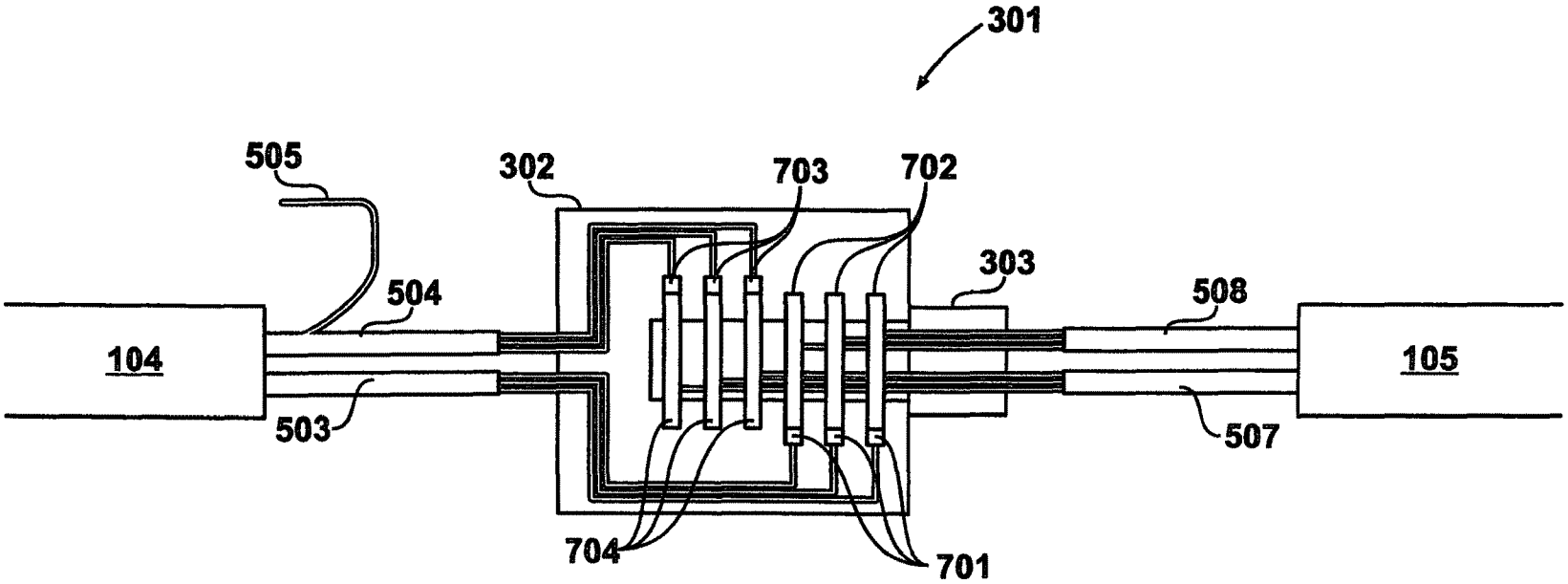
FIG. 7 shows electrical connections with and within the electrical rotary interface inside the rotatable coupling.

Electrical connections between the first portion 104 and the second portion 105 of the audio cable 102, facilitated by the electrical rotary interface 301, are shown in FIG. 7. First portion 104 includes tip conductor 503 and screen conductor 504, which is connected to the protective stator housing 304 via wire 505. Similarly, second portion 105 includes its own tip conductor 507 and screen conductor 508.

To facilitate rotary connection, electrical rotary interface 301 which, in the present embodiment, includes a plurality of rotating rings mounted on rotor 303 (which rings are identified as groups 702 and 704 in FIG. 7), and a plurality of static fingers mounted in stator 302 (which fingers are identified as groups 701 and 703 in FIG. 7). The rings and fingers are individually paired, so as to substantially maintain electrical contact during rotation of the rotor 303 relative to the stator 302. In the specific illustrated embodiment, six rings and six fingers are included in the electrical rotary interface 301. In addition, the rings and fingers are gold plated; thus each ring-finger connection presents only a small resistance of about ten milliohms.

While a single ring and a single finger could be used, it is however possible for electrical connection therebetween to be interrupted due to mechanical bounce. Thus the use of a plurality of ring-finger pairs connected in parallel presents advantages, in that conduction will be maintained even during bounce events between one ring-finger pair. There is also a reduction in the overall resistance exhibited by the electrical rotary interface 301 when connecting ring-finger pairs in parallel.

Thus in a specific embodiment, the first tip conductor 503 is split into three and is connected to each one of a first group of fingers 701, comprising three fingers. Each one of this first group of fingers 701 maintains contact with a respective one of a first group of rings 702. The second tip conductor 507 is split into three and connected to each one of the first group of rings 702.

Similarly, the first sleeve conductor 504 is split into three and is connected to each one of a second group of fingers 703, comprising three fingers. Each one of this second group of fingers 703 maintains contact with a respective one of a second group of rings 704. The second sleeve conductor 508 is split into three and connected to the each one of the second group of rings 704.

Thus in the present embodiment, connection of the tip conductors 503 and 507, and the sleeve conductors 504 and 508 across three respective ring-finger pairs reduces the total resistance of the electrical rotary interface 301 by a factor of three, to, in the present example, about three milliohms.

Should more conductors be required in the audio cable, such as to accommodate three-conductor one-quarter inch phone connectors with a ring conductor in addition to tip and sleeve conductors, then an electrical rotary interface with more ring-finger pairs may be employed. Alternatively, the number of ring-finger pairs connected in parallel could be reduced.

FIG. 8

Figure 8:
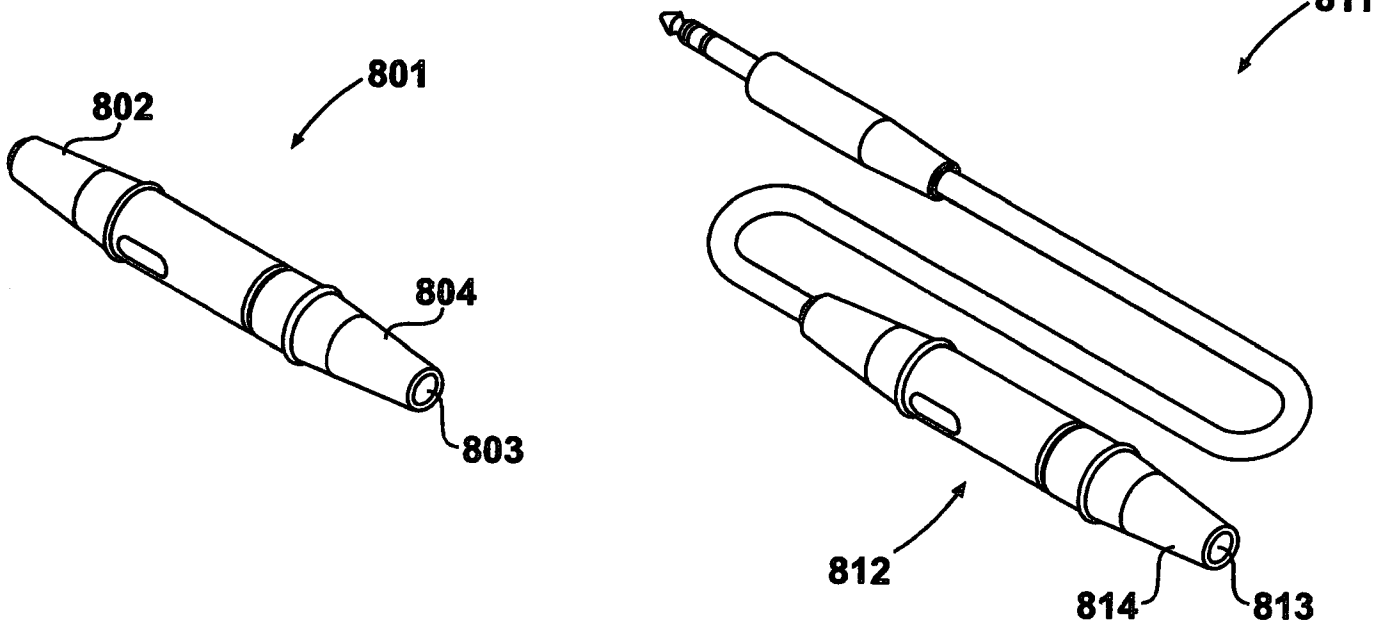
FIG. 8 shows an alternative embodiment of the rotatable coupling and an alternative embodiment of the audio cable.

Two alternative embodiments of the rotatable coupling of the present invention are illustrated in FIG. 8.

An alternative rotatable coupling 801 is substantially similar to rotatable coupling 103, but in the illustrated embodiment, includes a first audio connector socket (not shown) in a first end cap 802, and a second audio connector socket 803 in a second end cap 804. In this way, it may be used with existing audio cables that have a compatible audio connector plug. In this example, the audio connector type is a one-quarter inch two-contact phone connector, although other connector types could be used including those with additional conductors as described with reference to FIG. 7.

Referring again to FIG. 8, an alternative audio cable 811 is substantially similar to audio cable 102, and retains the shorter-length first portion of cabling with its one-quarter inch audio connector. However, this alternative audio cable 811 has a rotatable coupling 812 that includes an audio connector socket 813 in a second end cap 814, in a similar way to the rotatable coupling 801. This embodiment allows existing lengths of guitar cable for example to be used, while allowing guitarists to take advantage of the vertical orientation of the rotatable coupling during use without needing to source custom short lengths of cable.

What we claim is:

1. An apparatus for providing a rotatable coupling between a first audio cable and a second audio cable, comprising:

an electrical rotary interface having a stator and a rotor providing continuous connection between said first audio cable and said second audio cable;

a protective stator housing in which said stator is retained to rotate therewith;

a protective rotor housing in which said rotor is retained to rotate therewith; and a rotor-element bearing with an inner race and an outer race, wherein said protective rotor housing is journaled in said inner race and said outer race is journaled in said protective stator housing;

whereby the protective housings are axially rotatable relative to one another.

2. The apparatus of claim 1, wherein said stator is retained by a first snap ring which is located in a first groove in said inner surface of said protective stator housing.

3. The apparatus of claim 2, in which said rotor-element bearing is retained in said protective stator housing by a second snap ring located in a second groove in said inner surface of the protective stator housing.

4. The apparatus of claim 3, wherein said protective rotor housing is retained in said rotor-element bearing by a third snap ring located in a groove in said outer surface of the protective rotor housing.

5. The apparatus of claim 1, wherein said rotor-element is a ball bearing.

6. The apparatus of claim 1, further comprising:

a first collet on said protective stator housing for clamping said first audio cable; and a second collet on said protective rotor housing for clamping said second audio cable.

7. The apparatus of claim 6, further comprising:

a first audio connector socket in said protective stator housing into which said first audio cable is adapted to be plugged, using a first audio connector plug thereon; and a second audio connector socket in said protective rotor housing into which said second audio cable is adapted to be plugged, using a second audio connector plug thereon.

8. The apparatus of claim 7, further comprising a first connection between a sleeve of said first audio connector socket and said protective stator housing.

9. The apparatus of claim 7, wherein:

said stator includes six conductive fingers and said rotor includes six conductive rings, wherein each one of said conductive fingers is configured to maintain electrical contact with an exclusive one of said conductive rings during rotation; and three of said conductive fingers are configured to conduct an audio signal from the tip of the first audio connector plug via three of said conductive rings to a tip of the second audio connector plug; and three of said conductive fingers are configured to conduct an audio signal from a ring of the first audio connector plug via three of said conductive rings to a ring of the second audio connector plug.

* * * * *